US007059640B2

(12) United States Patent
Tensing et al.

(10) Patent No.: US 7,059,640 B2
(45) Date of Patent: Jun. 13, 2006

(54) LOCK, ESPECIALLY FOR THE DOORS, FLAPS OR THE LIKE, OF MOTOR VEHICLES

(75) Inventors: Matthias Tensing, Köln (DE); Petra Hildebrandt, Ratingen (DE)

(73) Assignee: Huf Hülsbeck & Fürst GmbH & Co. KG, Velbert (DE)

( * ) Notice: Subject to any disclaimer, the term of this patent is extended or adjusted under 35 U.S.C. 154(b) by 0 days.

(21) Appl. No.: 10/481,383

(22) PCT Filed: Jun. 14, 2002

(86) PCT No.: PCT/EP02/06530

§ 371 (c)(1),
(2), (4) Date: Dec. 18, 2003

(87) PCT Pub. No.: WO03/006769

PCT Pub. Date: Jan. 23, 2003

(65) Prior Publication Data

US 2004/0174021 A1 Sep. 9, 2004

(30) Foreign Application Priority Data

Jul. 11, 2001 (DE) ..... 101 33 092

(51) Int. Cl.
*E05C 3/06* (2006.01)

(52) U.S. Cl. ..... 292/201; 292/216

(58) Field of Classification Search ..... 292/216, 292/201, DIG. 23

See application file for complete search history.

(56) References Cited

U.S. PATENT DOCUMENTS

| | | | | |
|---|---|---|---|---|
| 5,411,302 | A * | 5/1995 | Shimada | 292/201 |
| 5,639,130 | A * | 6/1997 | Rogers et al. | 292/216 |
| 6,386,599 | B1 * | 5/2002 | Chevalier | 292/201 |
| 6,550,825 | B1 * | 4/2003 | Ostrowski et al. | 292/199 |
| 6,557,910 | B1 * | 5/2003 | Amano | 292/201 |
| 6,565,131 | B1 * | 5/2003 | Roos | 292/201 |

FOREIGN PATENT DOCUMENTS

| | | |
|---|---|---|
| DE | 101 57 473 A1 | 5/2002 |
| EP | 0109656 | 5/1984 |
| FR | 2768761 | 3/1999 |

* cited by examiner

*Primary Examiner*—Gary Estremsky
(74) *Attorney, Agent, or Firm*—Friedrich Kueffner

(57) ABSTRACT

A lock especially for the doors, flaps or the like, of motor vehicles. The lock includes a rotating latch (11) into which a closing element (20) is inserted, when the door is closed. The rotating latch (11) is pivoted out of an open position into a main locking position, via a pre-locking position. The lock also comprises a catch (21) which, in the pre-locking position, engages in a pre-stop notch provided on the rotating latch (11), and in the main locking position, engages in the main stop notch (14) positioned on the rotating latch. The lock also includes a motor-driven closing/opening auxiliary unit for the door, having a drive part (29) and a drive device (30) with at least two output elements (37, 38) which act on the rotating latch (11) or the catch (21). The lock further comprises a control for positioning the closing and opening auxiliary unit in an active or passive position, wherein the output elements (37, 38) are continuously coupled to the drive part (29) in such a way that the two output elements (37, 38) are displaced in an isochronous manner when the drive part (29) is switched on.

7 Claims, 6 Drawing Sheets

LOCK, ESPECIALLY FOR THE DOORS, FLAPS OR THE LIKE, OF MOTOR VEHICLES

BACKGROUND OF THE INVENTION

1. Field of the Invention

The invention pertains to a lock of the type indicated above for use in the doors or hinged lids of motor vehicles. The lock includes a rotary latch which has both a secondary stop notch and a primary stop notch, into each of which a catch can drop. When an open door is closed, a gap sometimes remains, because the catch has dropped only into the secondary stop notch of the rotary latch. The rotary latch then remains in the secondary latching position. To close the gap, motorized auxiliary closing means are used, which act on the rotary latch, moving the rotary latch onward into a final position, in which the catch can drop into the primary stop notch. This final position is called the "primary latching position" in the following.

2. Description of the Related Art

In the known lock of this type (FR 2 768 761 A1), a motor is connected to a gear assembly by a rotating disk, which is used both as an auxiliary closing means and as an auxiliary opening means. The rotating disk is connected by a drive rod to a drive element guided in a connecting link; the drive element turns the rotary latch from its original secondary latching position onward into the primary latching position. This secondary latching position is monitored by a microswitch, which turns on the motor. A sensor stops the motor when the primary latching position is reached. When a control command is sent to open the door, the motor and the rotary disk are actuated and move in the same rotational direction as they do during a closing operation. Numerous components such as link guides and intermediate levers are required so that the motor, which always rotates in the same direction, can be used both to open and to close the door. Such components are subjected to a great deal of wear.

Another known lock (EP 0 109 656 A) has a common electric motor to serve both as an auxiliary opening means and as an auxiliary closing means for a rotary latch, but two different freewheels are required for this purpose. The one freewheel is operational only during the closing process, the other only during the opening process. This is the only way in which it is possible for the cam that moves the latch to be actuated during the closing process while the cam acting on the catch remains at rest. During the opening process, however, the cam belonging to the latch remains at rest, while the cam is actuated to disengage the catch. A complicated and bulky gear assembly is required to operate these two freewheels.

SUMMARY OF THE INVENTION

The invention is based on the task of developing an inexpensive lock of the type indicated above that is of compact design.

In accordance with the present invention, the lock includes a gear assembly with first and second gear wheels, wherein a first power takeoff element is connected to and rotatable with the first gear wheel and a second power takeoff element is connected to and rotatable with the second gear wheel, and wherein the first gear wheel is mounted ahead of the second gear wheel.

The direction in which the drive unit operates determines whether the auxiliary means fulfills an opening function or a closing function. There is no need to turn on or turn off the components of the gear assembly.

It is advantageous for the gear assembly to comprise two axes and for a power takeoff element to be assigned to each one of these axes. Gear wheels of different diameter can also be mounted on these axes, so that different drive torques can be advantageously applied to the power takeoff elements. Thus the specific requirements of the two different auxiliary opening and closing functions can be met.

The power takeoff element which functions as the auxiliary opening means can have, for example, a connecting element, which can lift the catch out of the primary stop notch on the rotary latch when the power takeoff element moves.

It is also advantageous to provide a blocking element on the flank of the catch to limit the travel, in the auxiliary opening direction, of the connecting element or of the power takeoff element functioning as the auxiliary opening means. When the power takeoff element/connecting element makes contact with the blocking element and is thus stopped, a signal can be triggered, which turns off the motorized drive of the lock and/or which triggers the return of the gear assembly via the motorized drive back to the home position. No additional control means for returning the gear assembly and/or the motorized auxiliary opening/closing means to the home position are therefore required.

It is also favorable for the power takeoff element which serves as auxiliary closing means to have a connecting element, which, when the power takeoff element is actuated, cooperates with a shoulder on the rotary latch; that is, this connecting element exerts a certain force on the shoulder and thus moves the rotary latch in the closing direction into an "overstroke" position. When the overstroke position is reached and the connecting element or the power takeoff element is thus prevented from moving any farther, a drive stop signal and/or a signal for returning the gear assembly or the motorized auxiliary closing/opening means to the home position can again be triggered. In this case, too, the need for additional control means for returning the motorized auxiliary closing means to the home position is eliminated.

BRIEF DESCRIPTION OF THE PREFERRED EMBODIMENTS

Additional measures and advantages of the invention can be derived from the subclaims, from the following description, and from the drawings, which illustrate an exemplary embodiment of the invention:

DETAILED DESCRIPTION OF THE PREFERRED EMBODIMENTS

Figure 1:
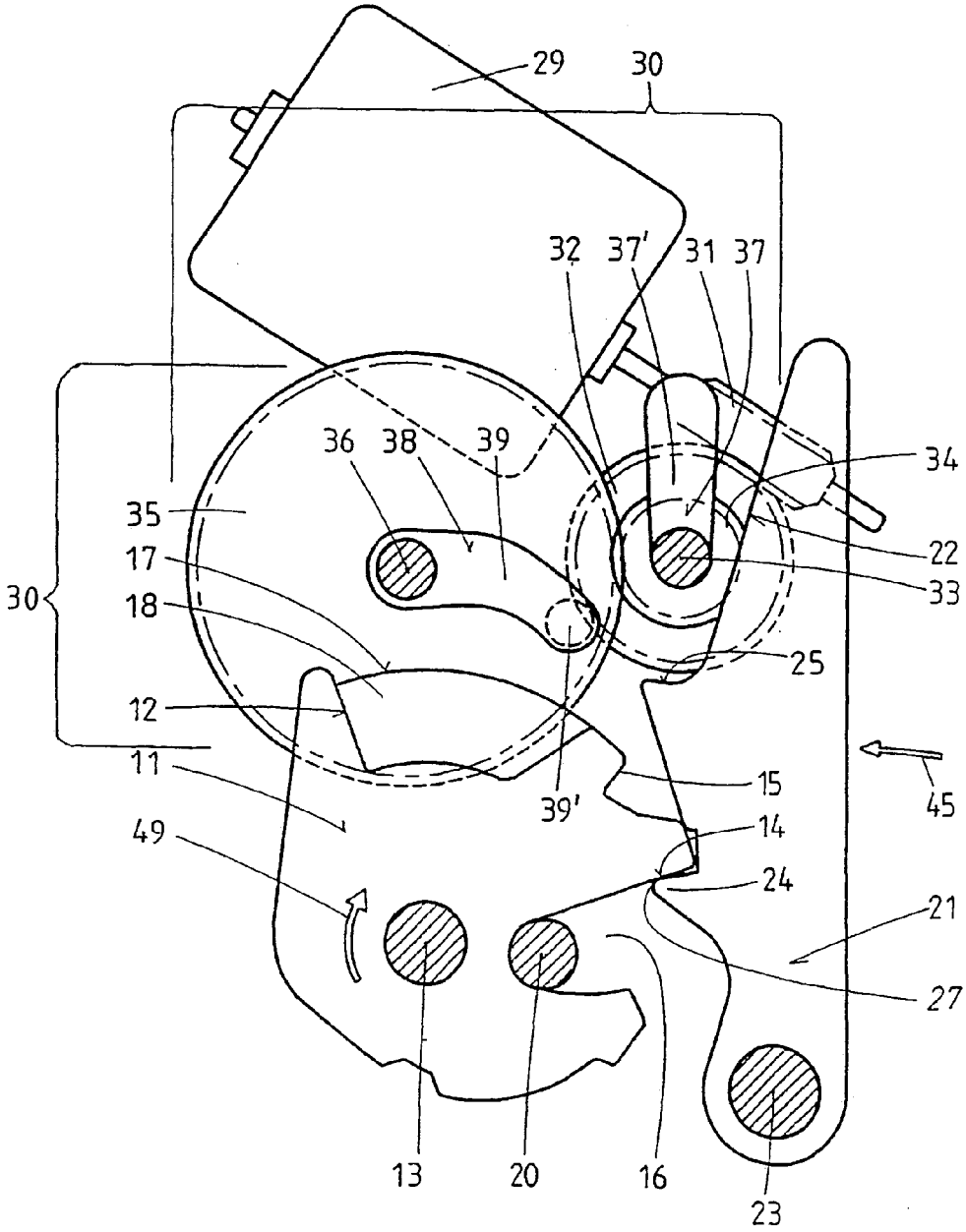
FIG. 1 shows a schematic diagram of a lock according to the invention in its primary latching position and of the drive in the home position.

FIG. 1 shows a lock according to the invention with a drive motor 29 and a gear assembly 30 in its home position. The lock shown here can be installed in a lock housing (not shown), for example, and mounted together with this lock housing on or in a door, hinged lid, hatch, etc., of, for example, a motor vehicle. In addition to the drive motor 29 and the gear assembly 30, the lock also includes a rotary latch 11, which, when the lock is in the locked state, is held in the primary latching position by a catch 21. The locking of a door to an opposing upright of a motor vehicle is accomplished here by way of a closing part 20, which, when the rotary latch 11 is in the primary latching position, is located in an opening 16 in the rotary latch 11. The rotary latch 11 is mounted pivotably on a bearing journal 13. The catch 21 is also mounted pivotably on a bearing journal 23. A primary stop notch 14 is also provided on the rotary latch 11; when the lock is in the locking position, a latching hook 24 of the catch 21 engages in this main notch, which establishes the primary latching position of the lock. A secondary stop notch 15 is also provided on the rotary latch 11; when the lock is in the secondary latching position, the latching hook 24 engages in or on this secondary notch.

An elastic force acts on the catch 21 in the direction of the arrow 45. This force can be produced by a spring element, for example, which can exert force on the catch. This elastic force 45 tries to push the catch toward the rotary latch.

The rotary latch 11 is also spring-loaded in the direction of arrow 49 by appropriate means mounted on the rotary latch 11. The elastic force 49 is oriented toward the open position of the rotary latch 11; the opening movement of the rotary latch 11 is thus supported by the spring loading 49.

The gear assembly 30 comprises the following components: On the shaft of the motor drive 29, a worm 31 is mounted, which meshes with a worm gear 32. Via the worm 31 and the worm gear 32, a driving movement is transmitted from the drive motor 29 to the axis 33. A gear wheel 34 and a power takeoff element 37 are also mounted on this axis 33; in the present exemplary embodiment, the power takeoff element is designed as a cam 37'. The gear wheel 34 meshes with a gear wheel 35, which is mounted on an axis 36. A power takeoff element/connecting element 38 is also mounted on this axis 36; this element comprises an arm 39, on the free end of which a cam 39' oriented toward the rotary latch 11 is mounted. The cam 39' can travel through a recess 18 in the rotary latch 11, and at the end of this recess 18 it meets a shoulder 12, via which the cam 39' can move the rotary latch 11 in the closing direction against the force of the spring loading 49.

The functions of the lock according to the invention are now to be described on the basis of FIGS. 2–6.

Figure 2:
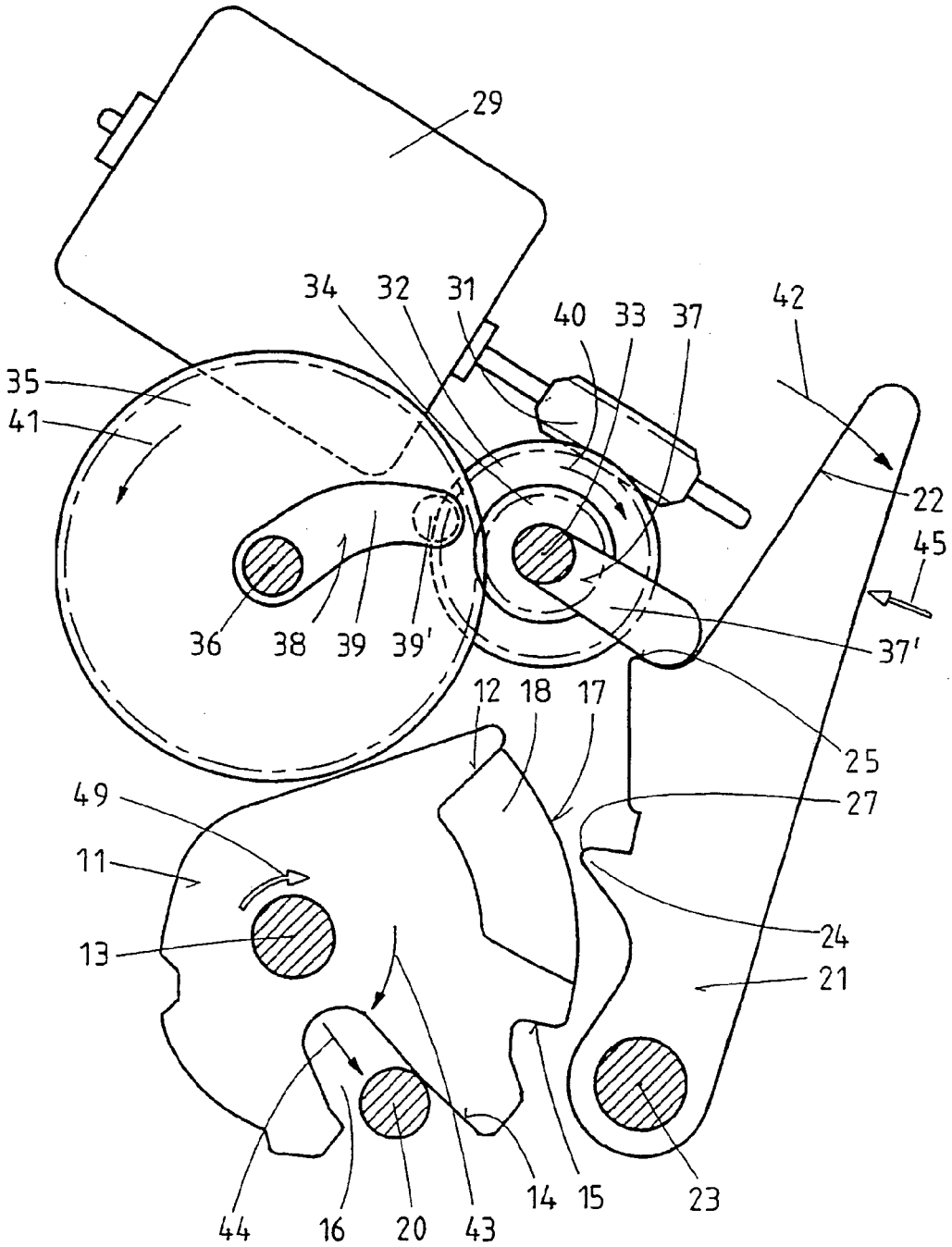
FIG. 2 shows a schematic diagram of the lock in the release position of the rotary latch.

Based on the home position of the motorized auxiliary opening/closing means shown in FIG. 1 and the primary latching position of the lock also shown there, FIG. 2 shows how the catch 21 and its latching hook/counter-latching part 24 is lifted out of the primary stop notch 14 of the rotary latch 11 by the operation of the drive motor 29 in the auxiliary opening direction. For this purpose, the gear wheel 34 is turned in the direction of the arrow 40. The power takeoff element 37, i.e., the cam 37', is thus also made to rotate in common with the axis 33 in the direction of arrow 40, as a result of which the free end of the cam meets the flank 22 of the catch 21, and as the cam continues to pivot, it is thus able to push the catch 21 out of the primary stop notch 14 in the rotary latch 11 against the spring-loading force acting in the direction of the arrow 45. The gear wheel 35, which meshes with gear wheel 34, is moved in the opposite rotational direction as indicated by arrow 41, and thus the power takeoff element 38 with the arm 39 and the cam 39' are also turned in the same direction. As can be seen in the drawing, the geometries of the gear assembly 30 and of the power takeoff 37, 38 are selected so that the power takeoff element 38 with its arm 39 and its cam 39' can travel freely past all of the elements mounted on the axis 36.

Because the catch 21 has now been removed from the primary stop notch 14 on the rotary latch 11, the rotary latch can now be pivoted by the spring-loading force 49 in the direction of the arrow 43, as a result of which the closing part 20 moves out of the recess 16 in the rotary latch 11 in the direction of the arrow 44. The lock is now in its release position, and the door, hinged lid, or hatch can be opened.

Figure 3:
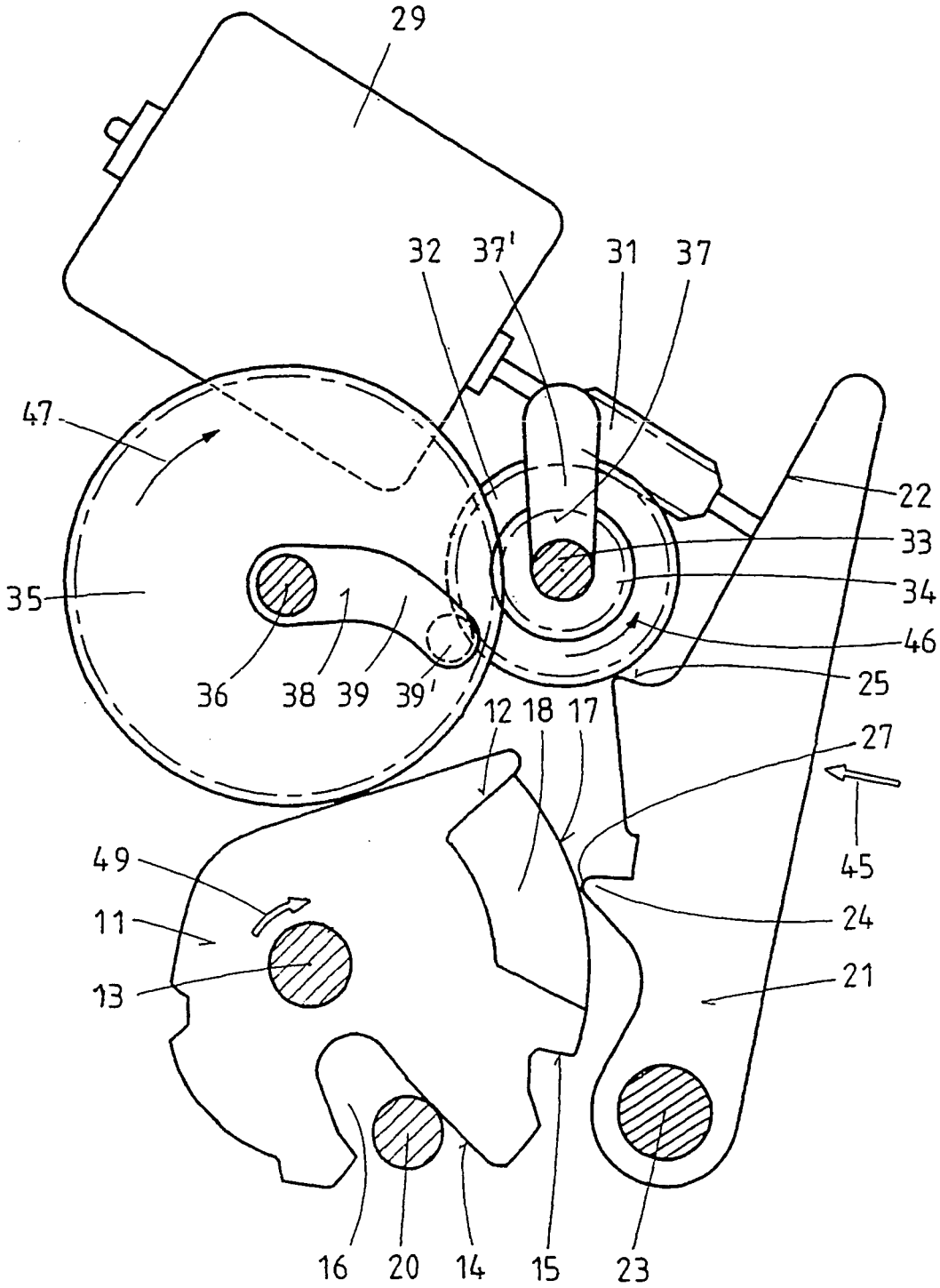
FIG. 3 shows a schematic diagram of the lock in the release position of the rotary latch and of the drive in the home position.

FIG. 3 now shows how the motorized auxiliary opening/closing means is returned to its home position. After the cam 37' has come to rest against the blocking element 25 of the catch 21 (see FIG. 2), the drive motor 29 is turned off by a control unit and then put into operation again for a certain period of time in the opposite direction. As a result, the gear wheel a 34 mounted on the axis a 33 is moved in the direction of the arrow 46 by the precise amount required to return the cam 37' to its home position, shown in FIG. 1. The drive element 38 and the gear wheel b 35 on the axis b 36 are also moved in the direction of arrow 47 by the precise amount required to return them to their home positions, as also shown in FIG. 1. The catch 21 is moved back again toward the rotary latch 11 by the spring loading acting on it until the support element 27 of the catch 21 comes to rest against the edge 17 of the rotary latch 11.

Figure 4:
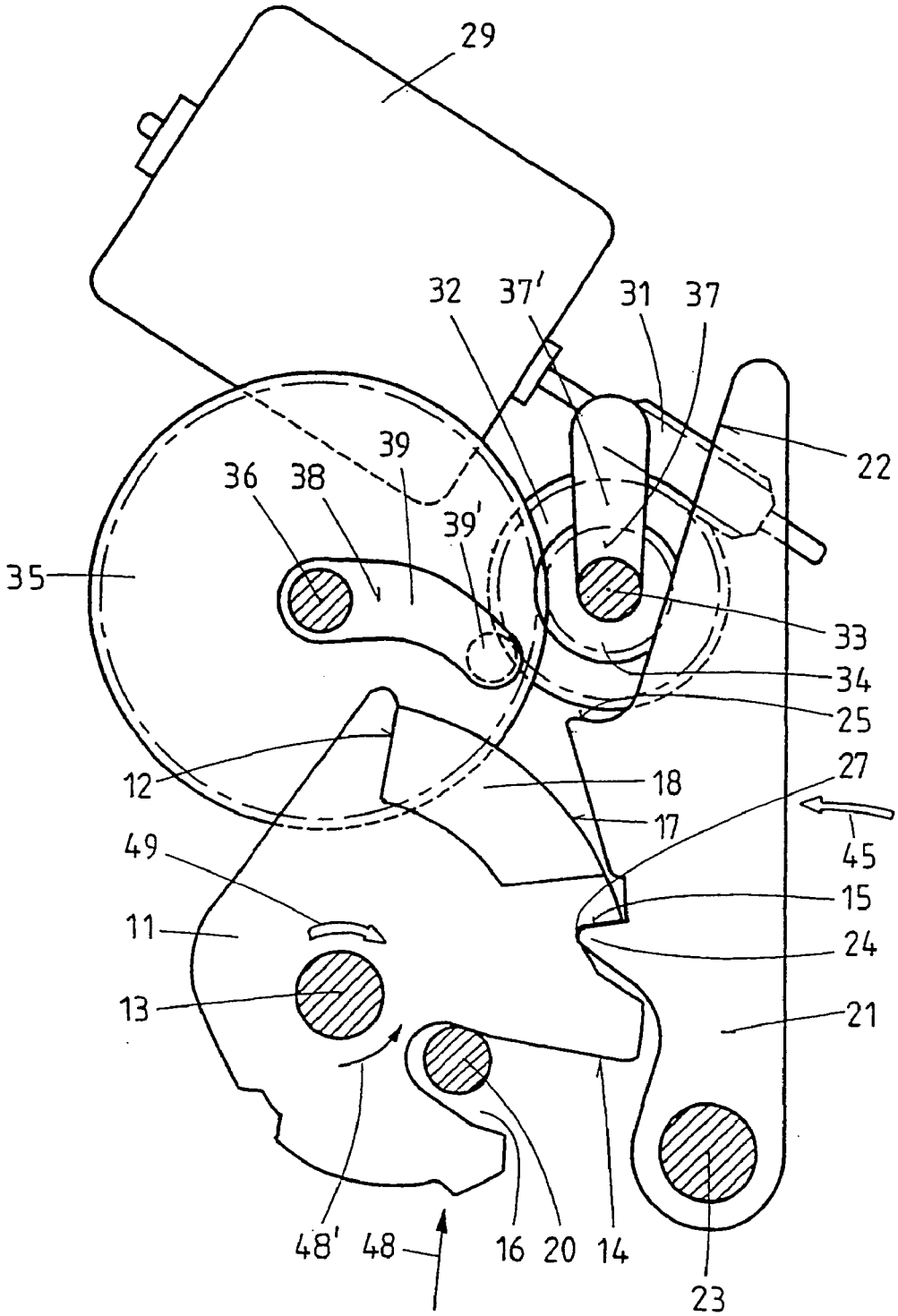
FIG. 4 shows a schematic diagram of the lock with the door closed and with the rotary latch in the secondary latching position.
Figure 5:
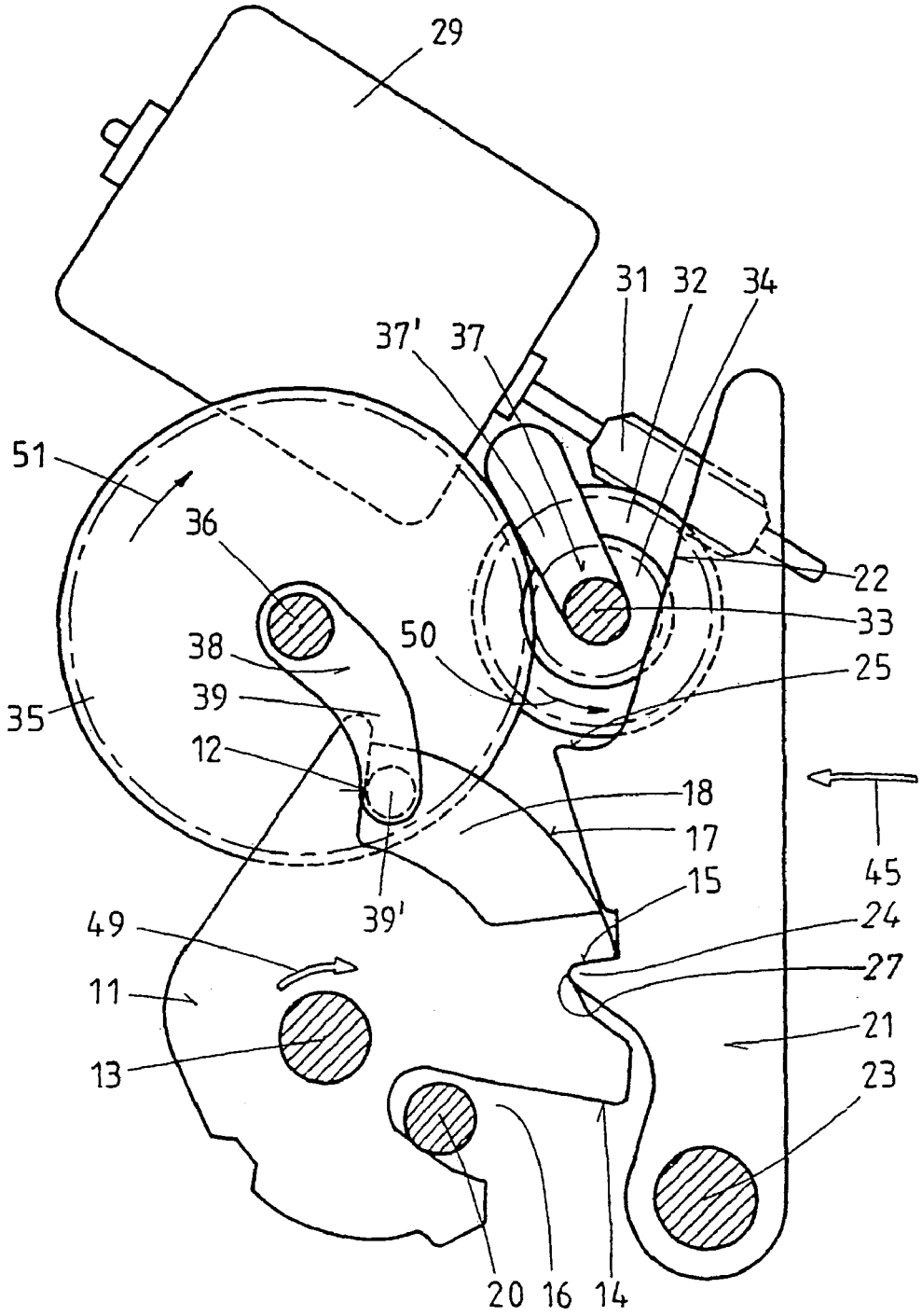
FIG. 5 shows a schematic diagram of the lock with the rotary latch in the secondary latching position and with the drive in the starting phase.
Figure 6:
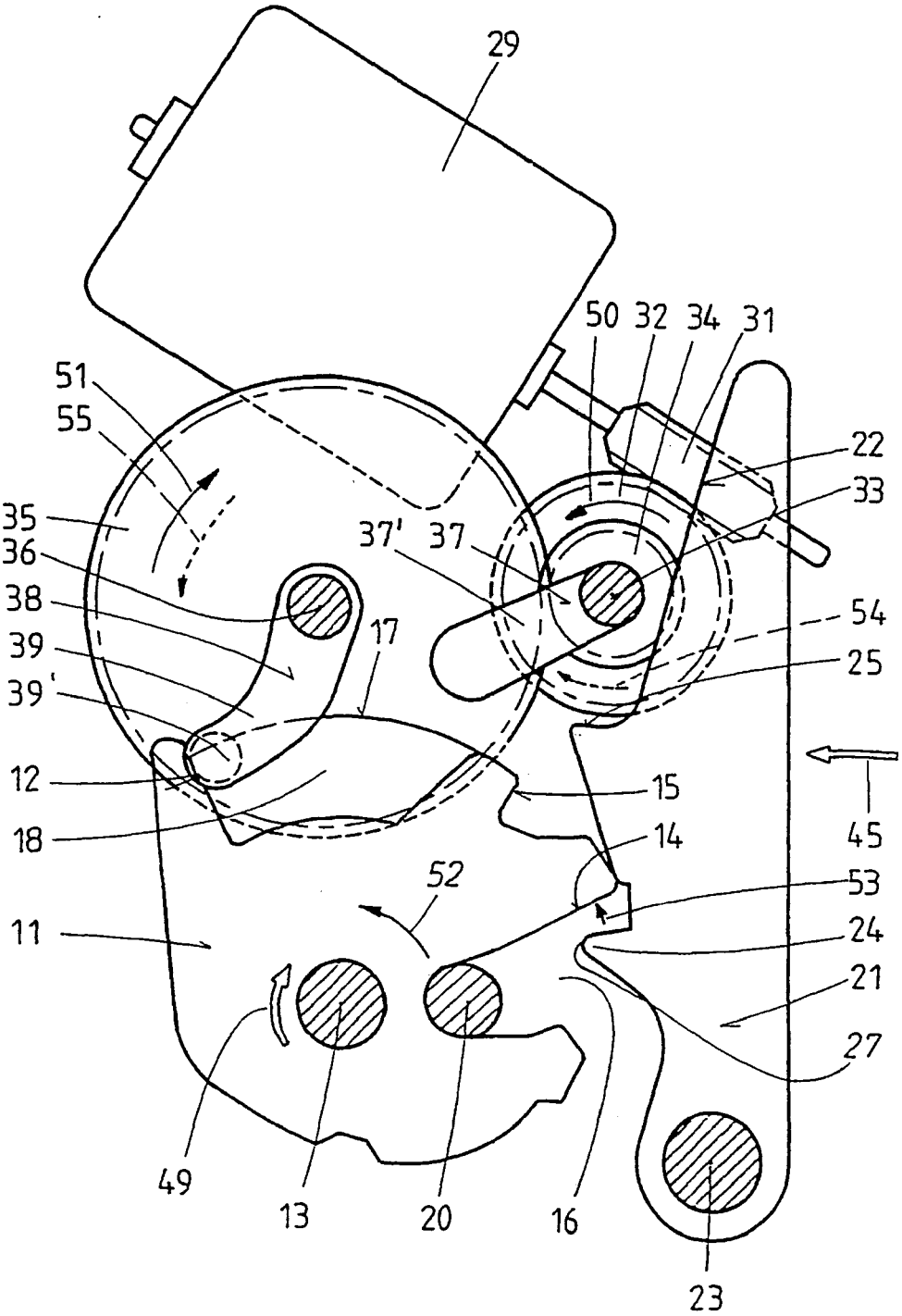
FIG. 6 shows a schematic diagram of the lock with the rotary latch in the overstroke position.

In FIG. 4, the lock has been switched to the secondary latching position of the rotary latch 11 by the manual shutting of the door, hinged lid, etc. The closing part 20 has thus been pushed in the direction of the arrow 48 into the recess 16 in the rotary latch 11; as a result, the rotary latch 11 has been pivoted in the direction of arrow 48', against the spring-loading force acting on it in the direction of arrow 49. The support element 27 of the catch 21 has traveled along the edge 17 of the rotary latch 11 until it has dropped into the secondary stop notch 15 of the rotary latch 11, where it now acts as a latching hook 24 to prevent the rotary latch 11 from pivoting back in the direction of the spring-loading force 49. The catch 21 remains pressed against the rotary latch 11 by its spring-loading force 45. The secondary latching position is detected by a sensor on the lock, which then actuates the drive motor 29 so that it can serve as an auxiliary closing means. The movement of the motor is transmitted via the worm 31 to the worm gear 32, which moves in the direction of the arrow 50. This rotational movement is transmitted by the gear wheel a 34 to the gear wheel b 35, which then rotates in the direction of arrow 51. The power takeoff element 38 with its arm 39 and its cam 39', mounted together with the gear wheel b 35 on the axis b 36, is also pivoted in the direction of the arrow 51 until it meets the shoulder 12 of the rotary latch 11 (compare FIG. 5). After the cam 39' has contacted the shoulder 12 on the rotary latch 11, the rotary latch 11 is, as can be seen in FIG. 6, pivoted further in the direction of arrow 52 until the rotary latch has arrived in an overstroke position, in which the primary stop notch 14 is located above the latching hook 24 by a distance equivalent to the overstroke indicated by the arrow 53. The lobe in which the primary stop notch 14 is located has thus moved past latching hook 24, and the catch 21 has been pushed away briefly from the rotary latch 11 in opposition to the spring-loading force according to the arrow 45.

In this overstroke position, sensors trigger the shut-off of the motor, this being followed by a return of the motorized auxiliary closing/opening means in the directions of arrows 55 and 54. The power takeoff elements 38 and 37 are also moved back in the directions of arrows 55 and 54 to their home positions shown in FIG. 1, and the rotary latch 11 is returned from its overstroke position to its primary latching position, as shown in FIG. 1.

The only comment left to be made is that the embodiment shown here represents only one example of how the invention can be realized. The invention is not limited to this embodiment. For example, the gear wheels can also be designed as traction wheels.

LIST OF REFERENCE NUMBERS

11 rotary latch
12 shoulder on 11
13 bearing journal of 11, axis of rotation
14 primary stop notch on 11
15 secondary stop notch on 11
16 recess in 11 for 20
17 edge of 11
18 recess in 11 for 38
20 closing part
21 catch
22 flank of 21
23 bearing journal of 21, pivot axis
24 counter-latching point, latching hook on 21
25 blocking element on 21
27 support element on 21
29 drive unit, drive motor
30 gear assembly
31 worm
32 worm gear
33 axis of 32, 34
34 gear wheel, traction wheel
35 gear wheel, traction wheel
36 axis of 35
37 power takeoff element on 33/37' connecting element, cam
37' connecting element
38 power takeoff element on 36
39 connecting element/arm of 38
39' connecting element/cam on 39
40 arrow (rotational direction of gear wheel upon actuation as auxiliary opening means)
41 arrow (rotational direction of gear wheel upon actuation as auxiliary opening means)
42 arrow (pivoting movement of 21)
43 arrow (pivoting movement of 11)
44 arrow (disengaging movement of 20 from 16)
45 arrow (spring loading of 21)
46 arrow (return movement of gear wheel)
47 arrow (return movement of gear wheel)
48 arrow (manual switching of 11 and 21 to the secondary latching position)
48' arrow (pivoting movement of 11)
49 arrow (spring-loading of 11)
50 arrow (rotational direction of gear wheel upon actuation as auxiliary closing means)
51 arrow (rotational direction of gear wheel upon actuation as auxiliary closing means)
52 arrow (pivoting movement of 11)
53 arrow (overstroke of 11)
54 arrow (return movement of gear wheel)
55 arrow (return movement of gear wheel)

What is claimed is:

1. Lock, especially for the doors, hinged lids, etc., of motor vehicles, with a rotary latch (11), into which a closing part (20) travels when the door, hinged lid, etc., is closed and thus pivots the rotary latch (11) from an open position via a secondary latching position into a primary latching position;

with a catch (21), which drops into a secondary stop notch (15) provided on the rotary latch (11) to establish the secondary latching position and then drops into a primary stop notch (14) on the rotary latch (11) to establish the primary latching position;

with a motorized auxiliary closing/opening means for the door, comprising a drive unit (29) and a gear assembly (30);

wherein the gear assembly comprises at least two gear wheels (34, 35) and two power takeoff elements (37, 38), wherein one power takeoff element (37) act on the rotary latch (21) and the other power takeoff element acts on the catch (21);

with drive control means for activating and deactivating the auxiliary closing and the auxiliary opening means; and wherein the first power takeoff element (37) acts as the auxiliary opening means on the catch (21) in a first operating direction of the drive unit (29); and the second power takeoff element (38) acts on the rotary latch (11) as the auxiliary closing means in an operating direction of the drive unit (29) opposite the first direction;

where the power takeoff elements (37, 38) are connected to the drive unit (29) at all times, so that the two power takeoff elements (37, 38) are made to move simultaneously when the drive unit (29) is operating, wherein the first power takeoff element (37) is connected so as to rotate with the first gear wheel (34) and the second power takeoff element (38) is connected so as to rotate with the second gear wheel (35);

wherein the first gear wheel (34) is mounted ahead of the second gear wheel (35); and wherein the gear assembly (30) comprises two axes (33) and (36), the first gear wheel (34) and the first power takeoff element (37) are mounted on the first axis (33), and the second gear wheel (35) and the second power takeoff element (38) are mounted on the second axis (36).

2. Lock according to claim 1, wherein the power takeoff element functioning as an auxiliary opening means comprises a connecting element (37), which, upon actuation as an auxiliary opening means, meets a flank (22) of the catch (21) and thus lifts the catch (21) out of the primary stop notch (14) on the rotary latch (11) in opposition to the restoring force.

3. Lock according to claim 2, wherein a blocking element (25) is provided on the flank (22) of the catch (21), against which the connecting element (37) moves during a movement in the auxiliary opening direction and stops the motor (29); wherein when the connecting element (37) comes to rest against the blocking element (25), it triggers a drive stop signal and/or a signal for returning the gear assembly (30) to its home position.

4. Lock according to claim 1, wherein one of the power takeoff element (38) has a connecting element (39, 39'), which, when actuated as an auxiliary closing means, cooperates with a shoulder (12) on the rotary latch (11) and thus moves the rotary latch (11) in the closing direction into an overstroke position (53); wherein when the connecting element (39, 39') has reached the overstroke position (53), it triggers a drive stop signal and/or a signal for returning the gear assembly (30) to its home position.

5. Lock according to claim 1, wherein the rotational speed of the gear wheel (34), which drives the first power takeoff element (37), and the rotational speed of the gear wheel (35), which drives the second power takeoff element (38), satisfy the following formula:

$$V_a = V_b \times I_{b/a}$$

where $V_a$ is the rotational speed of gear wheel a (34); $V_b$ is the rotational speed of gear wheel b (35); and $I_{b/a}$ is the ratio between the number of teeth of gear wheel a (35) and the number of teeth of gear wheel b (34); and where $V_a > V_b$.

6. Lock according to claim 1, wherein one of the power takeoff elements (37) is comprised of a cam (37'), which is seated on the axis (33) of the first gear wheel (34).

7. Lock according to claim 1, wherein the second power takeoff element (38) is comprised of an arm (39), which is seated on the axis (36) of the second gear wheel (35), and in that a cam (39') is mounted on the free end of the arm (39).

* * * * *